US005954125A

United States Patent [19]

Mantegazza et al.

[11] Patent Number: 5,954,125

[45] Date of Patent: Sep. 21, 1999

[54] MULTI-ROW HEAT EXCHANGER

[75] Inventors: Carlo Mantegazza, Carate Brianza; Alfonso Citarella; Massimo Assi, both of Villasanta; Roberto Cazzaniga, Cinisello Balsamo, all of Italy

[73] Assignee: Carrier Corporation, Syracuse, N.Y.

[21] Appl. No.: 09/118,806

[22] Filed: Jul. 20, 1998

[51] Int. Cl.[6] ..... F28D 1/47

[52] U.S. Cl. ..... 165/149; 165/150; 165/151; 165/DIG. 498; 165/DIG. 499; 29/890.047

[58] Field of Search ..... 165/149–151; 29/890.047; 72/217, 321, 388

[56] References Cited

U.S. PATENT DOCUMENTS

| | | | |
|---|---|---|---|
| 1,490,933 | 4/1924 | McCabe | 72/321 |
| 1,571,558 | 2/1926 | Russell | 72/321 |
| 1,931,467 | 10/1933 | Young | 165/149 |
| 2,118,206 | 5/1938 | Kritzer et al. | 165/150 X |
| 2,886,296 | 5/1959 | Wright | 165/150 |
| 2,896,429 | 7/1959 | Karmazin | 165/149 X |
| 4,133,198 | 1/1979 | Huda et al. | 72/321 |
| 5,267,610 | 12/1993 | Culbert | 165/151 |

*Primary Examiner*—Allen Flanigan

[57] ABSTRACT

A multi-row heat exchanger includes tube holding devices positioned at the ends of the rows of heat exchange elements in the multi-row heat exchanger. One of the tube holding devices is fixedly secured to the tubes of each row of heat exchange elements. The other tube holding device is secured to the tubes of only one row of heat exchange elements. The latter tube holding device includes a slotted opening for receiving unsecured ends of the tubes in the other row of heat exchange elements. A process for forming the above multi-row heat exchanger is also disclosed.

15 Claims, 5 Drawing Sheets

MULTI-ROW HEAT EXCHANGER

BACKGROUND OF THE INVENTION

This invention relates to multi-row heat exchangers used in heating, ventilating and air conditioning systems. In particular, this invention relates to a particular type of multi-row heat exchanger and to how this type of multi-row heat exchanger is formed.

It has heretofore been known to take a plurality of tubes and lace them with heat exchange fins so as to produce a row of heat exchange elements. This lacing process often begins with first inserting the ends of the tubes through holes in a tube holding device before passing the tubes through holes in the heat exchange fins. The ends of the tubes are finally inserted through a second tube holding device. The thus laced tubes are next subjected to an expander process wherein an expansion element larger than the inner diameter of the tubes is forcibly moved through each tube. The tubes expand so as to secure the heat exchanger fins and the tube holding devices thereto.

The resulting row of heat exchange elements may be subjected to several bending operations so as to be transformed into a particular heat exchanger configuration for a heating, ventilating and air conditioning system. The bent row may also be joined to several other bent rows of heat exchange elements to form a multi-row heat exchanger. It has also been known to simultaneously bend a number of rows of heat exchange elements so as to form a particular heat exchanger configuration.

Regardless of whether the rows are bent separately or simultaneously, it is important that each of the bent rows be aligned with respect to each other in the ultimate multi-row heat exchanger. This usually means that the ends of the rows, typically defined by the tube holding devices at each end, must end up in alignment in the ultimate multi-row heat exchanger.

It is an object of this invention to provide a process for forming multi-row heat exchange elements wherein the risk of misalignment of the tube holding devices at each end of the multiple rows of fin coils is minimized.

It is another object of the invention to provide apparatus which allows multi-row heat exchange elements to be formed into a final heat exchanger configuration without risk of misalignment of the tube holding devices.

SUMMARY OF THE INVENTION

The above and other objects are achieved according to the present invention by a process that allows at least two rows of heat exchange elements to be simultaneously bent so as to form aligned rows of heat exchange elements in a multi-row heat exchanger configuration. The process preferably includes using tubes of at least two different lengths. The shorter length tubes will be used in an inner row of heat exchange elements whereas the longer length tubes will be used in an outer row of heat exchange elements. In accordance with the invention, the longer length tubes of the outer row are inserted into a first tube holding device. These longer length tubes are also inserted into the holes of many heat exchanger fins so as to form the outer row of heat exchange elements. The second or inner row of heat exchange elements is now formed by lacing the shorter length tubes with heat exchanger fins. The resulting inner row of heat exchange elements is next positioned relative to of the previously formed outer row of heat exchange elements. In accordance with the invention, a set of end portions of the tubes in the inner row are carefully positioned at a predefined distance with respect to a set of end portions of the tubes in the outer row. The predefined distance is calculated to be the total distance that the set of end portions of the tubes in the inner row will move relative to the set of end portions of the tubes in the outer row during various bending operations. The tubes of the inner and outer rows preferably next receive a second tube holding device. This latter tube holding device as well as the laced heat exchange fins are now secured to the tubes of both rows. The first tube holding device is also preferably secured at this time to only the tubes of the outer row of heat exchange elements.

The inner and outer rows of heat exchange elements are now subjected to a series of bending operations whereby the inner and outer rows are simultaneously bent. This will produce a particularly shaped multiple row heat exchanger configuration. The final bend of the two rows of heat exchange elements will result in the previously positioned end portions of the tubes in the inner row moving into a slotted opening in the first tube holding device originally mounted to the longer length tubes in the outer row of heat exchange elements. The end portions of the inner row will preferably be protected by the tube holding device previously securely mounted to only the outer row of tubes. The thus formed multiple row configuration of heat exchange elements may also include securing a connecting bracket between the first and second tube holding devices.

In the preferred embodiment, the connecting bracket between the first and second tube holding devices completes a three hundred-sixty degree heat exchanger configuration. The preferred embodiment also includes particularly shaped tubes within each row of heat exchange elements. The tubes are U-shaped with hairpin turns in the U-shaped ends comprising the end portions that are positioned at the predefined distance with respect to each other.

BRIEF DESCRIPTION OF THE DRAWINGS

Other objects and advantages of the present invention will be apparent from the following detailed description in conjunction with the accompanying drawings in which.

DESCRIPTION OF THE PREFERRED EMBODIMENT

Figure 1:
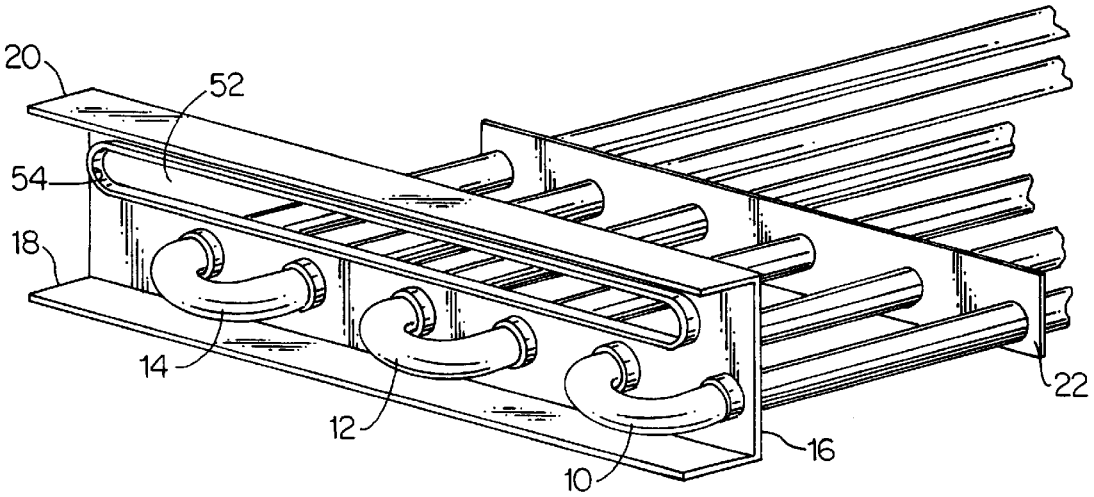
FIG. 1 illustrates the insertion of the a set of U-shaped tubes having hairpin turn ends into a tube holding device.

Referring to FIG. 1, tubes 10, 12 and 14 having hairpin turn ends at one end have been inserted into holes in a tube holding device 16. The tube holding device 16 includes extensions 18 and 20 which extend outwardly from a back portion of the bracket having holes therein for receiving the tubes. The extensions 18 and 20 extend outwardly beyond the hairpin turn ends of the tubes 10, 12 and 14. These extensions prevent any inadvertent contact with the hairpin turn ends that might otherwise occur. The tubes 10, 12 and 14 are also inserted into the holes of a large number of heat exchange fins such as 22. The resulting row of tubes with heat exchange fins mounted thereon will be hereinafter referred to as a "row of fin coils". This row of fin coils is identified as fin coil row 24 in FIG. 2.

Figure 2:
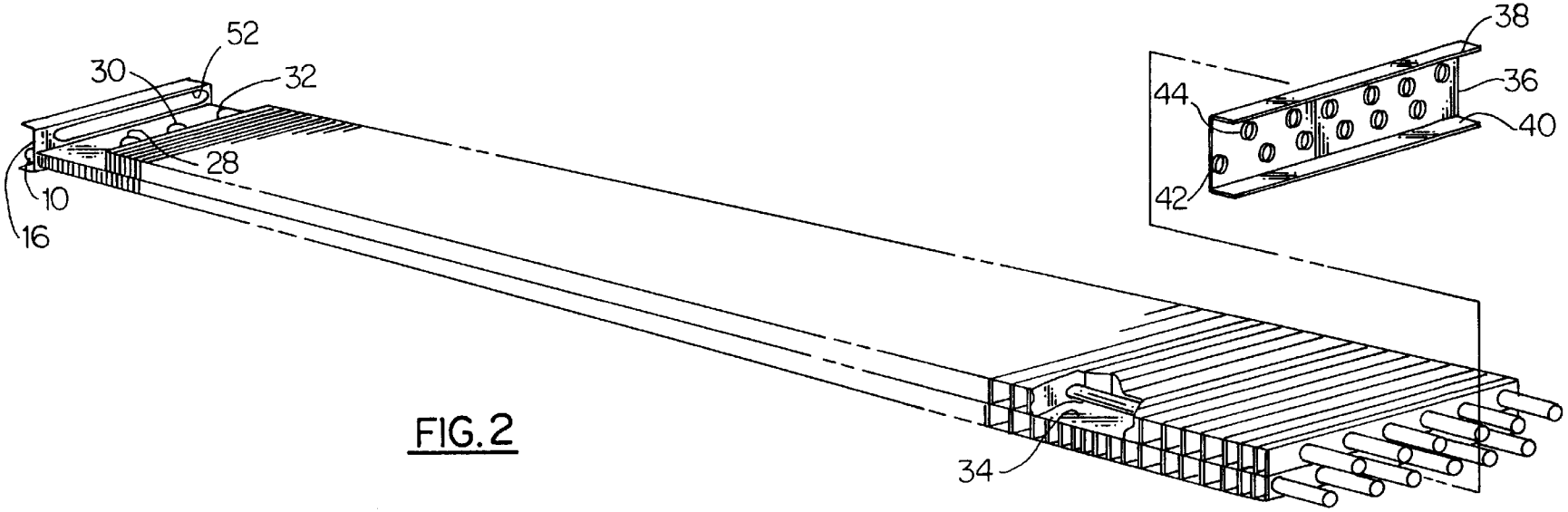
FIG. 2 illustrates the outer and inner rows of tubes with heat exchanger fins mounted thereon positioned relative to each other so as to receive a second tube holding device.

Referring to FIG. 2, it is to be noted that a second row 26 of fin coils is positioned on top of the fin coil row 24. The second row 26 of fin coils is formed by lacing a set of tubes 28, 30 and 32 also having hairpin turn ends with heat exchange fins. The tubes 28, 30 and 32 will not, however, have been initially inserted into a tube holding device. The tubes will also have been cut to a shorter length than the tubes 10, 12 and 14. The shorter length of the tubes 28, 30 and 32 takes into account the fact that the row 26 will ultimately become the inner row of a multi-row heat exchanger configuration that has a certain number of bends or turns in each row of fin coils. The row 24 will ultimately become the outer row of this multi-row heat exchanger configuration.

As will be explained in detail hereinafter, the hairpin turn ends of the fin coil rows 24 and 26 will move relative to each other. These fin coil rows are bent to form the multi-row heat exchanger configuration. In order to accommodate this movement, a thin sheet of low friction material 34 is placed on fin coil row 24 before fin coil row 26 is positioned thereover.

Figure 3:
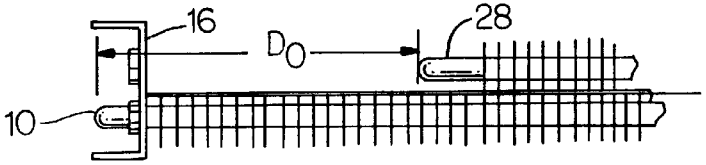
FIG. 3 illustrates the relative positions of the hairpin turn ends of the tubes in FIG. 2.

Referring to FIG. 3, the hairpin turn ends of the coils 28, 30 and 32 are seen to be positioned at a distance "$D_o$" from the hairpin turn ends of the tubes 10, 12 and 14. The distance "$D_o$" is the difference between the lengths of the tubes 10, 12 and 14 and the lengths of the tubes 28, 30 and 32. As will be explained hereinafter, the distance "$D_o$" represents the distance that the hairpin turn ends of the tubes in fin coil row 26 will move relative to the hairpin turn ends of the tubes in fin coil row 24 during the bending operations.

Referring to FIG. 2, the open ends of the tubes 28, 30 and 32 of the top fin coil row 26 as well as the open ends of the tubes 10, 12 and 14 of the fin coil row 24 receive a tube holding device 36. This device preferably includes extensions 38 and 40 similar to the extensions 18 and 20 of the tube holding device 16. The tube holding device 36 furthermore includes holes such as 42 and 44 for receiving the open ends of all of the tubes in both rows of fin coils. The thus inserted ends of the tubes will extend through these holes for a short distance and will preferably be in substantial alignment due to the lengths of the tubes in each row.

The assembled and aligned fin coil rows 24 and 26 including the tube holding devices 16 and 36 will now preferably be subjected to expander devices. In this regard, expander devices larger than the inner diameters of the tubes in each fin coil row will be forced into the straight portions of these tubes coils so as to expand the diameters of these straight portions against the perimeters of the holes in the tube holding devices 16 and 36 as well as in the heat exchanger fins. The thus expanded coils will securely fasten the tube holding devices and heat exchanger fins in the respective positions established in FIG. 2.

Figure 4:
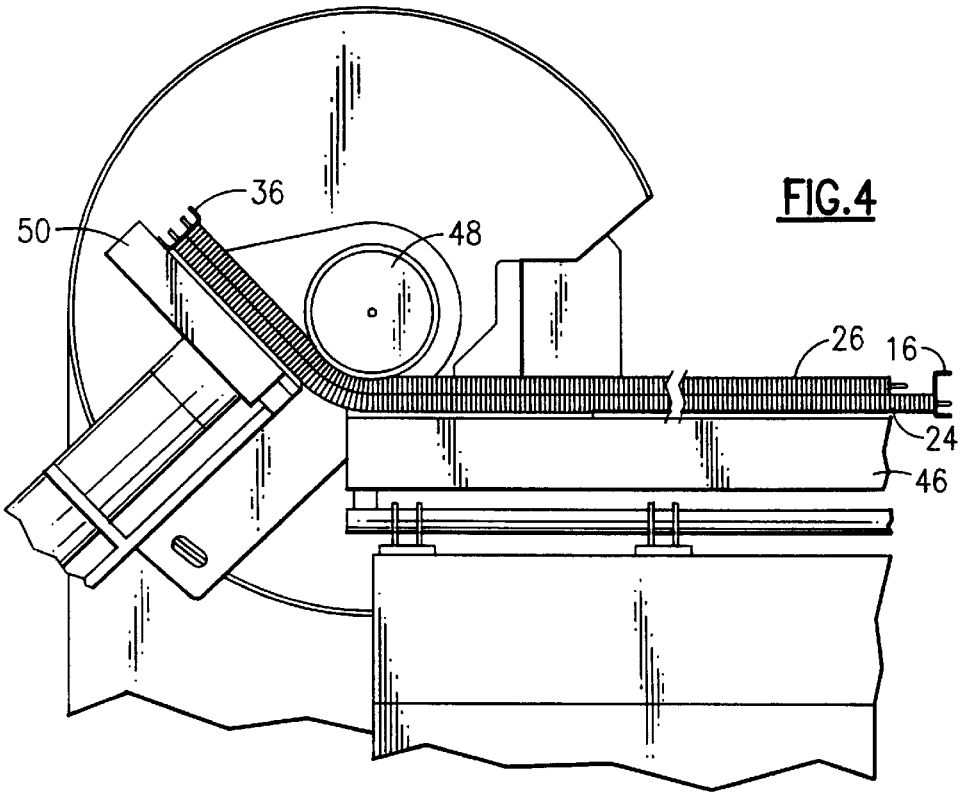
FIG. 4 illustrates the multiple rows of heat exchange elements of FIG. 2 being turned by a roller so as to form the first curvature in the multiple row heat exchanger configuration.
Figure 5:
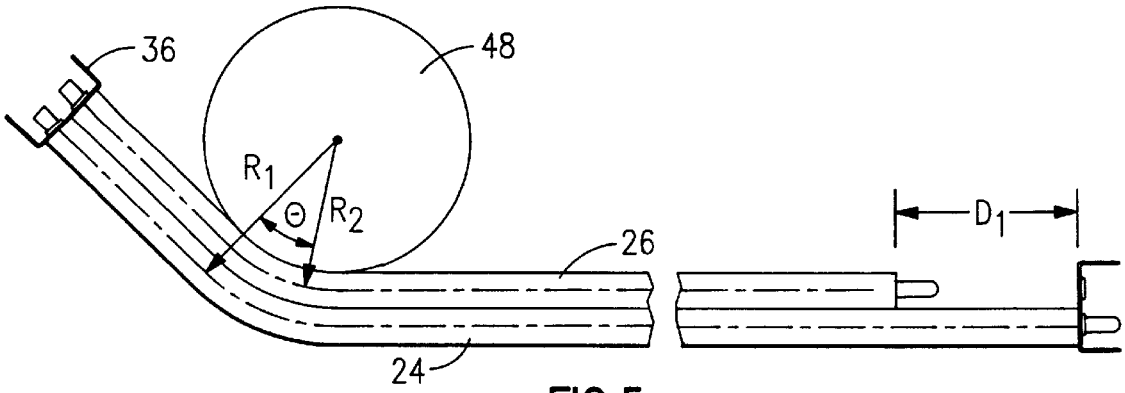
FIG. 5 illustrates the relative movement of the inner and outer rows of fin coils resulting from the bending operation of FIG. 4.

Referring to FIG. 4, the multi-row fin coil configuration of FIG. 2 is shown undergoing a first bending operation. The multi-row fin coil configuration is preferably positioned on a flat platen 46 so that the trailing portion of the multi-row fin coil configuration having the bracket 16 at its end lies substantially flat on the platen 46 during all bending operations. A roller 48 simultaneously turns both the outer fin coil row 24 and the inner fin coil row 26 in the direction defined by directional shaping plate 50 so as to form a curved arc or bend. Referring to FIG. 5, the fin coil rows 24 and 26 are seen to be bent by an angular amount θ. The average radius of curvature of the outer fin coil row 26 will be $R_1$ whereas the average radius of curvature for the inner fin coil row will be $R_2$. The bending of the outer row 24 and the inner row 26 by the angular amount θ will cause the hairpin turn ends of the tubes in the inner fin coil row 26 to move closer to the hairpin turn ends of the tubes in the fin coil row 24 by an amount "A". This particular amount "A" will be equal to the difference in radiuses of curvature as measured with respect to the centerlines of the respective rows of fin coils multiplied times the angle θ of curvature. In other words, "A" may be computed by the following formula:

$$A=(R_1-R_2)\theta$$

The above computation means that the distance $D_1$ between the hairpin turn ends of the coils in the fin coil rows 24 and 26 following the bending operation of FIG. 4 will be as follows:

$$D_1=D_o-A$$

It is to be appreciated that the multi-row fin coil configuration will be subjected to several further bending operations. Each successive bending operation will define a particular angle θ of curvature with respect to the particular bend. The distance by which the hairpin turn ends of the tubes in the tubes in the fin coil row 26 will move relative to the hairpin turn ends of the tubes in the hairpin row 24 will again be in accordance with the aforementioned calculation of the differential distance "A". Each subsequent bend will produce a new distance "$D_n$" between hairpin turn ends of the two rows that is equal to the previous distance "$D_{n-1}$" reduced by the particular differential distance "A" for the given bend.

Figure 6:
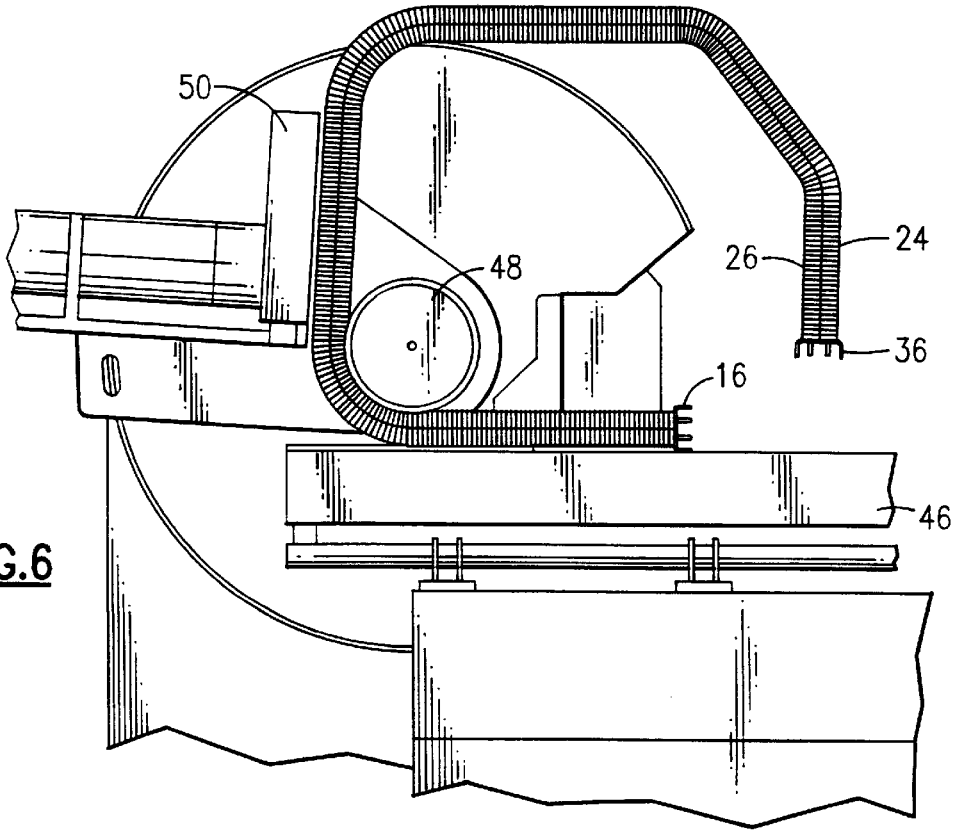
FIG. 6 illustrates the final bending of the multiple row heat exchanger configuration wherein the hairpin turn ends of the tubes in the inner row of heat exchange elements move into a lengthwise slot in the first tube holding device.

Referring now to FIG. 6, the final bending operation for the fin coil rows 24 and 26 is illustrated. It is to be noted that the hairpin turn ends of the tubes in the fin coil row 26 will have progressively moved closer to the hairpin turn ends of the tubes in the fin coil 24 as a result of the previous bending operations. The fin coil row 26 will, during the final bending operation of FIG. 4, result in the hairpin turn ends of the tubes 28, 30 and 32 moving into a slotted hole 52 in the tube holding device 16. The slotted hole opening is clearly shown in FIG. 1 and is seen to include a flange 54 located around the periphery of the slotted hole. The slotted hole is located at sufficient distance above the holes in the bracket 16 receiving the tubes 10, 12 and 14 so as to receive the hairpin turn ends of the tubes 28, 30 and 32. Referring to FIG. 6, it is to be noted that the trailing portion of the multi-row fin coil configuration is fully supported by the platen 46 during the final bending operation. This assures that the relative movement of the hairpin turn ends of the tubes 28, 30 and 32 into the slotted hole 52 occurs under full support of the fin coil rows 24 and 26 by the platen 46.

Figure 7:
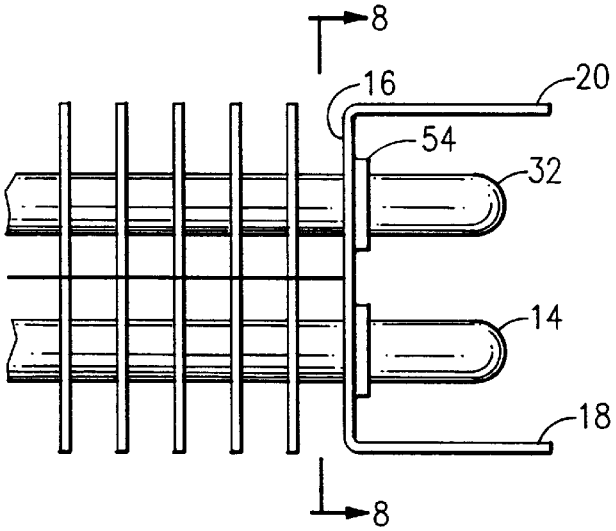
FIG. 7 is a detailed view illustrating the alignment of the hairpin turn ends of the tubes in the inner row of heat exchange elements with respect to the hairpin turn ends of the tubes in the outer row of heat exchange elements following the bending operation of FIG. 6.

Referring to FIG. 7, it is seen that the hairpin turn ends of the tubes 28, 30 and 32 will have moved into alignment with the hairpin turn ends of the lower set of tubes 10, 12 and 14 at the end of the final bending operation. The distance traveled by the hairpin turn ends of the coils 28, 30 and 32 will be the summation of the calculated distances, "A", for each respective bend of the multi-row fin coil configuration. This distance will be the distance "$D_o$" between the hairpin turn ends of the tubes in the fin coil rows 24 and 26 in FIG. 2.

Figure 8:
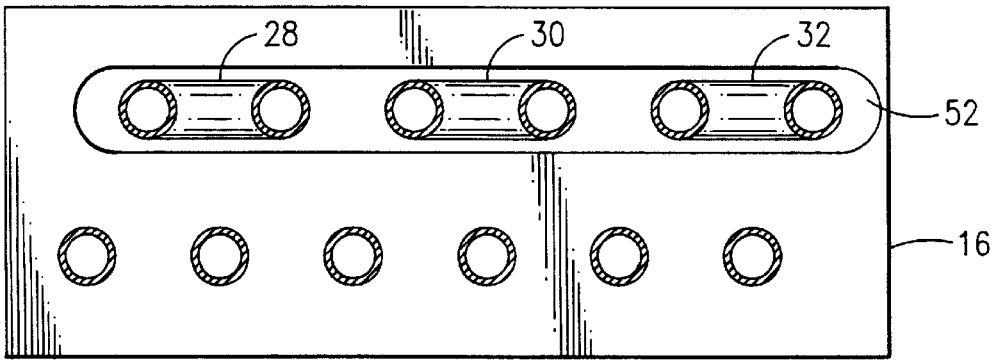
FIG. 8 illustrates the position of the hairpin turn ends of the tubes of the inner row of heat exchange elements within the lengthwise slot in the first tube holding device.

Referring to the tube holding device 16, it is to be noted that the extensions 18 and 20 will protect the hairpin turn ends of the tubes 28, 30 and 32 in much the same way as the hairpin turn ends of the tubes 10, 12 and 14 are protected. Referring to FIG. 8, the slotted hole 52 in the bracket 16 is of sufficient length and height to permit the hairpin turn ends of the tubes 28, 30 and 32 to easily move into this opening. It is to be appreciated that the tolerances in the slotted hole 52 will be a function of the potential various that may occur in the presentation of the hairpin turn ends of the tubes 28, 30 and 32 during the final bending operation.

Figure 9:
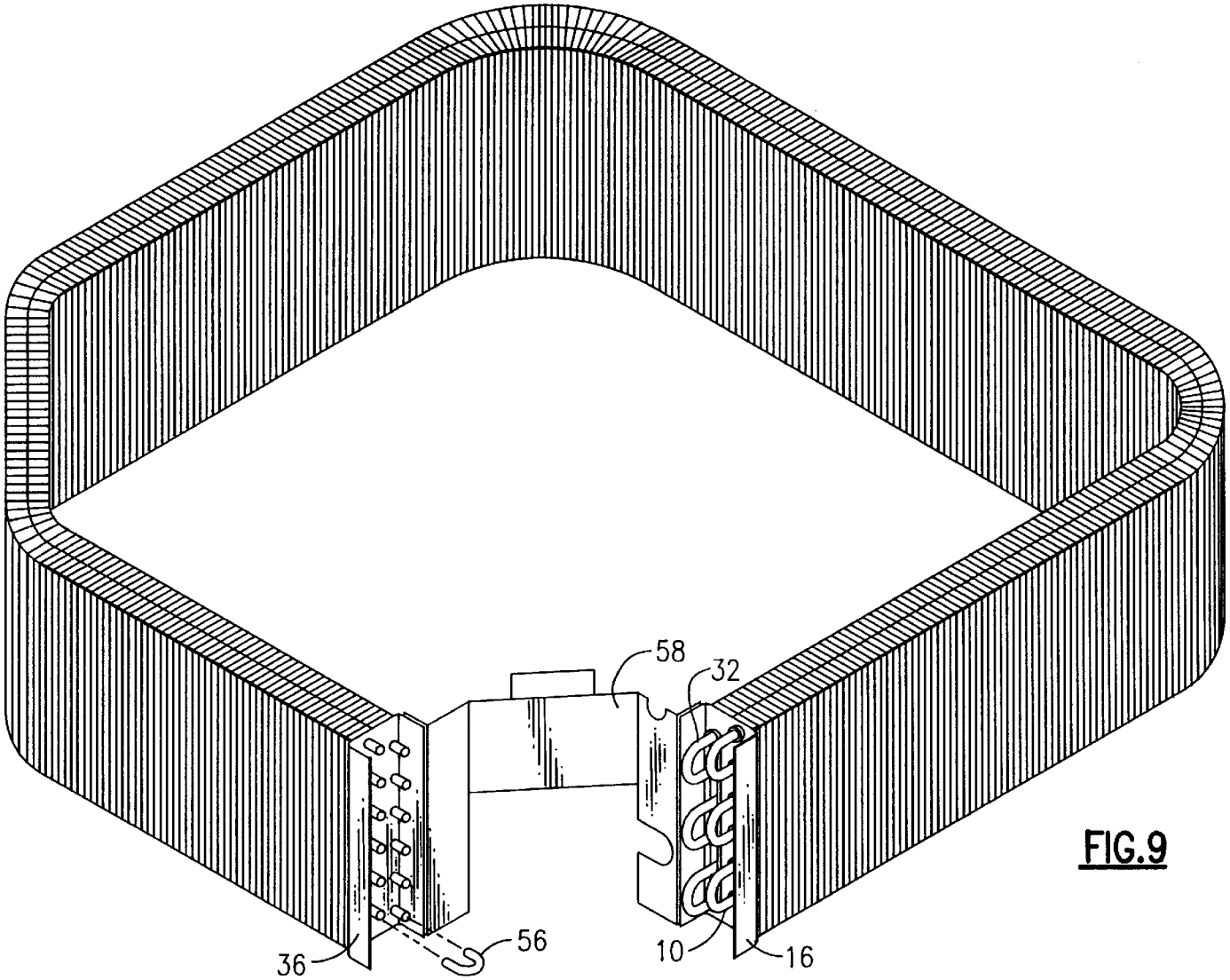
FIG. 9 is an illustration of a connecting piece being joined to the tube holding devices of the inner and outer rows of fin coils.

Referring to FIG. 9, the resultingly formed multi-row fin coil configuration is illustrated. It is to be seen that the successive bending operations of the fin coil rows have produced a particular heat exchanger configuration wherein the tube holding devices 16 and 36 are at a relatively short distance from each other. As is well known in the art, the open ends of the tubes contained within the tube holding device 36 are normally connected by hairpin turn loops such as 56 which are braised thereto in a braising operation.

Referring to FIG. 9, a connecting plate 58 has been secured to the tube holding devices 16 and 36. The connecting plate 58 will fix the positions of the tube holding devices relative to each other and will furthermore add structural support to the entire multi-row fin coil configuration. This particular fin coil configuration may be used in a number of heating, ventilation and air conditioning systems wherein it is desirable to have the heat exchange elements substantially surround a source for radially distributing air through this configuration.

While the invention has been described with reference to a preferred embodiment, it will be understood by those skilled in the art that various changes may be made thereto without departing from the scope of the invention. For example, the number of rows of fin coils that are to be subjected to successive bending operations may include more than two fin coil rows. The hairpin turn ends of each successive inner row would insert into appropriate slotted openings in the installed bracket on the outer row of fin coils. It is also to be appreciated that the tubes need not have hairpin turn ends at one end. In this regard, the invention would work equally well with for instance straight tubes that are interconnected with for instance braised hairpin turn loops or other shaped loops after having been formed into a multi-row fin coil configuration in accordance with the invention. It is also to be appreciated that the resulting multiple row fin coil configuration may assume any number of ultimate shapes. For the above reasons, it is therefore intended that the invention not be limited to the particular embodiment disclosed, but that the invention include all embodiments falling within the scope of the claims hereinafter set forth.

What is claimed is:

1. A process for forming a multi-row heat exchanger comprising the steps of:

inserting a first set of U-shaped tubes into predefined holes within a first tube holding device and further inserting the U-shaped tubes through a plurality of heat exchange fins so as to form a first row of heat exchange elements;

inserting a second set of shorter length U-shaped tubes through holes in a plurality of heat exchange fins so as to form a second row of heat exchange elements;

positioning the second row of heat exchange elements with respect to the first row of heat exchange elements whereby a set of end portions of the shorter length U-shaped tubes are at a predefined distance from a corresponding set of end portions of the U-shaped tubes in the first row of heat exchange elements;

inserting a second tube holding device onto the U-shaped tubes in both the first and second row of heat exchange elements;

securing the heat exchange fins and the second tube holding device to the U-shaped tubes in the first and second rows of heat exchange elements;

securing the first tube holding device to only the U-shaped tubes in the first row of heat exchange elements; and bending the first and second rows of heat exchange elements at least once whereby the set of end portions of the U-shaped tubes in the second row of heat exchanger element moves closer to the corresponding set of end portions of the U-shaped tubes in the first row of heat exchange elements during each bending operation and wherein the set of end portions of the U-shaped tubes in the second row of heat exchange elements moves into a slotted opening within the first U-shaped tube holding device during the final bending operation.

2. The process of claim 1 wherein the total distance traversed during all bending operations by the set of end portions of U-shaped tubes in the second row of heat exchange elements is equal to the predefined distance by which the set of end portions of the shorter length U-shaped tubes in the second row are from the corresponding set of end portions of the U-shaped tubes in the first row of heat exchange elements during said step of positioning the second row of heat exchange with respect to the first row of heat exchange elements.

3. The process of claim 1 wherein said step of bending the first and second rows of the heat exchange elements further comprises:

positioning the first and second rows of heat exchange elements on a platen so that the first tube holding device secured to only the U-shaped tubes in the first row of heat exchange elements is supported by the platen during each bending operation.

4. The process of claim 1 wherein said step of bending the first and second rows of heat exchange elements comprises the step of:

positioning the first and second rows of heat exchange elements on a platen so that the platen supports the first and second rows of heat exchange elements for a substantial distance during the final bending operation whereby the first tube holding device secured to only the U-shaped tubes in the first row of heat exchange elements is fully supported by the platen as the set of end portions of the U-shaped tubes in the second row approach the slotted opening in the first tube holding device.

5. The process of claim 1 wherein said step of positioning the second row of heat exchange elements with respect to the first row of heat exchange elements comprises the step of:

providing a thin sheet of low friction material between the first and second rows of heat exchange elements whereby the set of end portions of the U-shaped tubes in the second row of heat exchange elements may move relative to the corresponding end portions of the U-shaped tubes in the first row of heat exchange elements.

6. The process of claim 1 wherein the sets of end portions of the U-shaped tubes positioned at the predefined distance with respect to each other include hairpin turns defining the U-shape of the U-shaped tubes.

7. The process of claim 6 wherein the first tube holding device includes projections extending outwardly from a portion of the tube holding device having the predefined holes therein for receiving the first set of U-shaped tubes and wherein said step of inserting a first set of U-shaped tubes into the predefined holes comprises the step of:

inserting the first set of U-shaped tubes into the first tube holding device until the hairpin turn ends of these tubes are covered by the outwardly extending projections of the first tube holding device.

8. Heat exchanger apparatus comprising:

a first row of heat exchange elements having a first set of a plurality of U-shaped tubes therein secured to a device for holding first end portions of the first set of U-shaped tubes in place relative to each other;

a second row of heat exchange elements having a second set of U-shaped tubes therein, said second set of U-shaped tubes having first end portions which freely extend through a slotted opening in the device for holding the first end portions of the first set of U-shaped tubes in place relative to each other; and a holding device, secured to second end portions of said first set of U-shaped tubes and furthermore secured to second end portions of said second set of U-shaped tubes, whereby the second end portions of both said first set of U-shaped tubes and said second set of U-shaped tubes are held rigidly in place with respect to each other.

9. The heat exchanger apparatus of claim 8 wherein said first and second sets of heat exchange elements are the outer and inner rows respectively of said heat exchanger apparatus and wherein the length along the centerline of the outer row of heat exchange elements is greater than the length along the centerline of the inner row of heat exchange elements, said first and second rows of heat exchange elements each having at least one curved arc wherein the curved arc length of the centerline of said first row of heat exchange elements is greater than the curved arc length of the centerline of said second row of heat exchange elements.

10. The heat exchanger apparatus of claim 8 wherein said device for holding the first end portions of the first set of U-shaped tubes in position relative to each other comprises:

a bracket having holes therein for defining the relative positions of the first end portions of the first set of U-shaped tubes relative to each other, said bracket furthermore containing the slotted opening for receiving the first end portions of the second set of U-shaped tubes.

11. The heat exchanger apparatus of claim 10 wherein said bracket further comprises:

a set of extensions extending outwardly from a back portion of the bracket to a point beyond the first end portions of both of the first and second sets of U-shaped tubes so as to protect the first end portions of the first set of U-shaped tubes held securely therein and the first end portions of the second set of U-shaped tubes freely extending through said slotted opening in said bracket.

12. The heat exchanger apparatus of claim 8 wherein said bracket furthermore comprises a flanged edge around the circumference of said slotted opening so as to present a flat contacting surface to said first end portions of the second set of tubes in the event of any contact therewith.

13. The heat exchanger apparatus of claim 8 wherein said second holding device secured to second end portions of said first set of U-shaped tubes and furthermore secured to second end portions of said second set of U-shaped tubes comprises:

a bracket having holes therein for defining the positions of the second end portions of said first set of U-shaped tubes and the positions of said second set of U-shaped tubes relative to each other.

14. The heat exchanger apparatus of claim 13 wherein said bracket having holes therein for defining the relative positions of the second end portions of both said first and second sets of U-shaped tubes relative to each other further comprises:

a set of extensions extending outwardly from a portion of said bracket to a point beyond the second end portions of the first and second set of U-shaped tubes being held rigidly in place with respect to each other.

15. The heat exchanger apparatus of claim 8 wherein the first end portions of said first set of U-shaped tubes and the first end portions of the second set of U-shaped tubes include hairpin turns.

* * * * *